US006877469B2

(12) United States Patent
Lau

(10) Patent No.: US 6,877,469 B2
(45) Date of Patent: Apr. 12, 2005

(54) CONTROL DEVICE FOR AN AIR VALVE OF AN ENGINE

(76) Inventor: Foo Wah Lau, Room 312, Fuk Shing Comm. Bldg., No. 28, On Lok Mun Street, On Lok Tsuen, Fanling, New Territories City Hong Kong Special Administrative Region (CN)

( * ) Notice: Subject to any disclaimer, the term of this patent is extended or adjusted under 35 U.S.C. 154(b) by 0 days.

(21) Appl. No.: 10/181,693

(22) PCT Filed: Oct. 9, 2001

(86) PCT No.: PCT/CN01/01472

§ 371 (c)(1),
(2), (4) Date: Sep. 27, 2002

(87) PCT Pub. No.: WO02/057601

PCT Pub. Date: Jul. 25, 2002

(65) Prior Publication Data

US 2003/0098001 A1 May 29, 2003

(51) Int. Cl.[7] ..... F01L 1/30

(52) U.S. Cl. ..... 123/90.24; 123/90.16; 123/90.15; 123/90.25; 123/90.39

(58) Field of Search ..... 123/90.15–90.17, 123/90.24–90.26, 90.39, 90.4, 90.41, 90.44, 90.45, 90.42, 90.27

(56) References Cited

U.S. PATENT DOCUMENTS 1,292,215 A * 1/1919 Zeitlin ..... 123/188.2
1,491,023 A * 4/1924 Belden ..... 123/90.27
1,612,792 A * 1/1927 Asbury ..... 123/90.41
2,954,017 A * 9/1960 Forstner ..... 123/90.15
3,572,299 A * 3/1971 Lester ..... 123/90.25
3,911,879 A * 10/1975 Altmann ..... 123/90.16
4,141,325 A * 2/1979 Shalaty ..... 123/90.3
4,440,121 A * 4/1984 Clancy et al. ..... 123/90.39
5,060,606 A * 10/1991 Hubbard ..... 123/90.39
5,782,215 A * 7/1998 Engelmann ..... 123/79 C
5,791,306 A * 8/1998 Williamson ..... 123/90.16
5,806,475 A * 9/1998 Hausknecht ..... 123/90.16
5,832,891 A * 11/1998 Paul ..... 123/198 F
6,138,624 A * 10/2000 Wolck et al. ..... 123/90.39

* cited by examiner

*Primary Examiner*—Thomas Denion
*Assistant Examiner*—Jaime Corrigan
(74) *Attorney, Agent, or Firm*—Dorsey & Whitney LLP

(57) ABSTRACT

The present invention provides a mechanism for controlling the intake valve of an internal combustion engine, which mechanism is capable of consuming less energy, i.e. less oil. Through uniquely designed cam and rocker as well as joining mechanism joining the rocker and the stopper, this mechanism does not incur the spring resistance as opening the intake valve, thus the engine per se does not additionally consume energy, so that the object of reducing oil cost and promoting power output may be achieved.

9 Claims, 8 Drawing Sheets

CONTROL DEVICE FOR AN AIR VALVE OF AN ENGINE

This application claims the priority of PCT Application No. PCT/CN01/01472, filed Oct. 9, 2001, and the priority of Chinese Application No. 01 1 00532.4, filed Jan. 20, 2001, which are incorporated herein by reference.

TECHNICAL FIELD

The present invention relates to the intake valve of an internal combustion engine, especially to a mechanism for controlling the intake valve of an internal combustion engine.

BACKGROUND OF THE INVENTION

A traditional mechanism for controlling the intake valve of an internal combustion engine is shown in FIGS. 10 and 11, it mainly includes a cam 200, a rocker 300, a stopper 400 and a spring 500. One end of the rocker 300 engages the cam 200, the other end presses the stopper 400. One end of the spring 500 presses the support 700 which is fixedly secured with respect to the cylinder wall 600, the other end abuts against the flange 800 mounted on the end of the stopper 400. As the cam 200 begins to rotate in clockwise direction from the position shown in FIG. 10, it pushes the left end of the rocker 300 upwardly, the rocker 300 then pivots and its right end presses the stopper 400 downwardly, thus, the stopper 400 overcomes the resistance of spring 500 and moves downwards, then, the intake valve is opened for admission or exhaust. As the cam rotates to the position shown in FIG. 11, the left end of the rocker 200 lowers and the right end rises, thus, under the action of the spring 500, the stopper 400 also rises so that the intake valve is closed for terminating admission or exhaust. As the cam continues rotating, the above course is repeated.

The above described traditional design requires a very large spring force, otherwise, if the rotation is fast, the spring will be incapable of closing the intake valve timely due to its small spring constant. However, if the spring constant is great, the rocker will correspondingly encounter a greater resistance as the cam pushes the rocker. In order to overcome this greater resistance, the engine will consume more energy.

OBJECT OF THE INVENTION

With respect to the above problem, the object of the present invention is to provide a mechanism for controlling the intake valve of an internal combustion engine, which mechanism is capable of consuming less energy, i.e. less oil. Through uniquely designed cam and rocker as well as joining mechanism joining the rocker and the stopper, this mechanism does not incur the spring resistance as opening the intake valve, thus the engine per se does not additionally consume energy, so that the object of reducing oil cost and promoting power output may be achieved.

SUMMARY OF THE INVENTION

The mechanism for controlling the intake valve of an internal combustion engine according to the present invention comprises a cam, a rocker and a joining mechanism joining the rocker and the stopper. Wherein, the cam is formed on the crank shaft, its shape is similar to ellipse. The rocker may rock about an axis through its center. One side of the rocker has two arms forming a "V" shape, said two arms engage the cam. The other side of the rocker has only one arm, the first cooperating part, the second cooperating part and the third cooperating part are formed in the end of this one arm. From the bottom to the top, the joining mechanism includes the bottom plate, the spiral spring, the lower cooperating unit, the first connection element, the upper cooperating unit and the second connection element. The spiral spring is pressed between the lower cooperating unit and the bottom plate and its spring constant is comparatively small. The upper end of the stopper passes through the opening centered in the bottom plate and the inner hole of the spiral spring and is mounted on the lower cooperating unit. The lower cooperating unit and the upper cooperating unit are assembled together by means of the first connection element. The upper cooperating unit is capable of sliding with respect to the first connection element. Moreover, the upper cooperating unit and the bottom plate are mounted together by means of the second connection element. At the initial position of each cycle, the cam engages one of the two arms in the rocker, the first cooperating part of the rocker engages the upper cooperating unit, the second cooperating part of the rocker engages the lower cooperating part. Accompanying the rotation of the cam, the rocker rocks, and the second cooperating part will downwardly press the lower cooperating unit so that the stopper is pushed to open the intake valve. Moreover, the third cooperating part will shift to engage the upper cooperating part. Accompanying the continued rotation of the cam, the other arm of the two arms will engage the cam, the rocker thus rocks in reverse direction, the third cooperating part will upwardly push the upper cooperating unit so that the intake valve is closed. At last, the first cooperating part returns to engage the upper cooperating unit.

BRIEF DESCRIPTION OF THE DRAWINGS

The present invention will be further described below by means of the preferred embodiment with reference to the accompanied drawings, wherein.

EMBODIMENT FOR IMPLEMENTING THE PRESENT INVENTION

Figure 1:
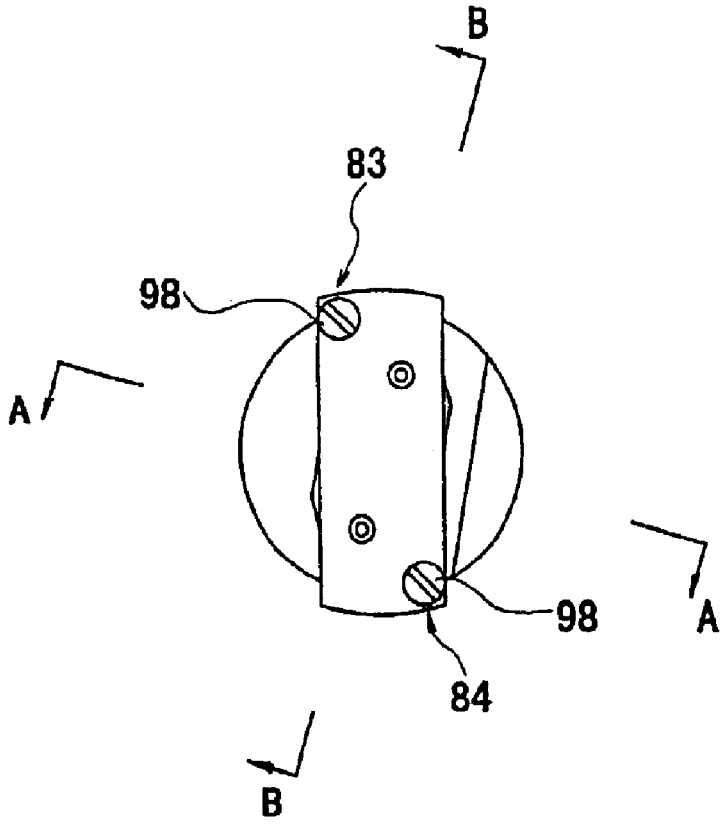
FIG. 1 is a schematic top plan view illustrating the joining mechanism of the mechanism for controlling the intake valve of an internal combustion engine according to the present invention.
Figure 2:
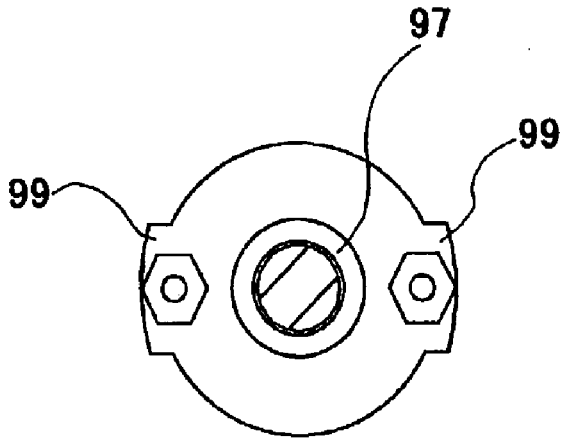
FIG. 2 is a schematic bottom view illustrating the joining mechanism of the mechanism for controlling the intake valve of an internal combustion engine according to the present invention.

As shown in the figures, the mechanism for controlling the intake valve of an internal combustion engine according to the present invention mainly includes a cam 10, a double-arm rocker 20 and a joining mechanism 100 joining the double-arm rocker and the stopper. Wherein, the cam 10 is formed on the crank shaft and shaped similar to ellipse. The rocker 20 is mounted on a shaft 26. Two arms 21 and 22 are formed in one end of the rocker 20. The ends of two arms are rounded and engage the cam. The other end of the rocker 20 is uniquely shaped to form a first cooperating part 23, a second cooperating part 24 and a third cooperating part 25. The structure of the joining mechanism 100 is in the form of a frame. From the bottom to the top, the joining mechanism 100 comprises a bottom plate 90, a spiral spring 40, a lower cooperating unit 110, first connection elements 95, 95, an upper cooperating unit 120 and a second connection element 98, 98. In one embodiment, the lower cooperating unit 110 comprises an intermediate support 50, a lower roller seat 60, a lower roller 65, the upper cooperating unit 120 comprises an upper roller seat 70, an upper roller 75 and a top plate 80. The first connection elements are two pins 95, 95 whose longitudinal section is shaped as trapezoid. The second connection element are two bolts 98, 98. Wherein, the bottom plate 90 is made from thin metal plate such as steel plate and in a substantial round shape. An opening 97 is formed in the center of the bottom plate 90, and two flanges 99, 99 symmetrically protrude from the circumferential edge in the direction along one diameter. Two holes for inserting bolts are formed in the flanges 99. The main body of the intermediate support 50 is in a cylindrical shape, a cylindrical protrusion 51 protrudes around the central axis from the lower surface of the main body. This protrusion 51 inserts into the inner hole of the spring 40. One portion of the main body of the intermediate support 50 is cut away on the side adjacent to the cam 10 so that a slope 56 is formed to facilitate the movement of the rocker 20. In addition, a stepped hole 52 is formed in the intermediate support 50 around its central axis. A cuboid lower roller seat 60 is formed on the upper surface of the intermediate support 50. A protrusion 61 protrudes downwardly from the center of the lower surface of the lower roller seat 60. The two longitudinal sides of the protrusion 61 have circumferential shape which matches the shape of the upper larger hole of the stepped hole 52 in the intermediate support 50, moreover, the lower surface of the protrusion 61 presses on the upper end of the stopper. In addition, a cuboid recess 62 is formed in the upper surface of the lower roller seat 60 for receiving the lower roller 65. A steel pad 64 is placed on the bottom of the recess 62. The upper roller seat 70 also has a cuboid shape, and also a cuboid recess 72 is formed on the upper surface for receiving the upper roller 75. A slot 73 is cut out in the lower part of the upper roller seat 70 so that the upper roller is exposed for cooperating with the rocker. Adjacent to the outer circumference of the intermediate support 50, two stepped holes 53, 54 are symmetrically provided with their central axes parallel to the central axis of the intermediate support. At the longitudinal end of the lower roller seat 60, two through holes 63, 66 concentric with the through holes 53, 54 are provided. In addition, at the longitudinal end of the upper roller seat 70, two through holes 76, 77 concentric with the through holes 53, 54 are provided. The diameter of the through holes 63, 66 in the lower roller seat 60 is the same as the diameter of the smaller hole of the stepped holes 53, 54 in the intermediate support, the diameter of the through holes 76, 77 in the upper roller seat 70 is smaller than the diameter of the through holes 63, 66 in the upper roller seat 60. The intermediate support 50, the lower roller seat 60 and the upper roller seat 70 are assembled together by pins 95, 95 whose longitudinal section is trapezoid. The upper ends of pins protrude out after assembly. The top plate 80 is also made from thin metal plate such as steel plate and is in a substantial rectangular shape. The top plate is covered on the upper surface of the upper roller seat 70 by means of two holes 81, 82 in the top plate, said two holes 81, 82 are respectively located at two ends of one of the diagonal lines in the upper surface of the top plate. At two ends of the other diagonal lines, two bolt holes 83, 84 are provided. The top plate 80 and the bottom plate 90 are connected by two bolts 98, 98 passing through them. Moreover, the middle segment of the bolt matches the circular recesses in the side walls of the intermediate support so as to secure the intermediate support. The upper end of the stopper 30 passes through the hole 97 in the bottom plate 90 and the inner hole of the spiral spring 40 and is fitted in the smaller holes of the stepped hole 52 in the intermediate support 50 by means of a joint-element 31 separated into two halves and having a conical side surface.

It is necessary to state that the bottom plate 90 is free with respect to the cylinder wall 150 of the internal combustion engine after the assembled mechanism for controlling the intake valve of an internal combustion engine according to the present invention is mounted in the engine. Namely, the bottom plate 90 is capable of moving unrestrictedly relative to the cylinder wall 150. This point is greatly different from the prior art in which the support 700 is fixedly mounted relative to the cylinder wall 600.

Figure 3:
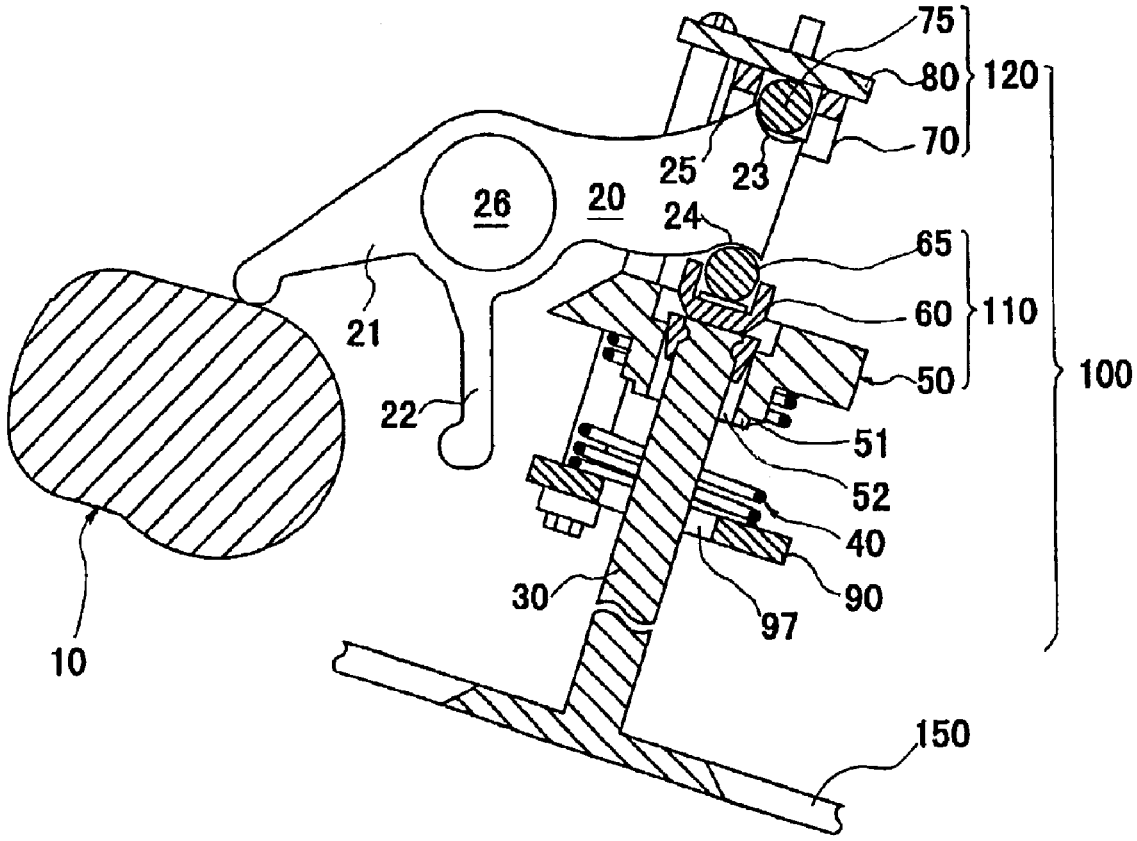
FIG. 3 is a schematic sectional view along line A—A in FIG. 1 illustrating the condition in which the mechanism for controlling the intake valve of an internal combustion engine according to the present invention is going to open the intake valve.
Figure 4:
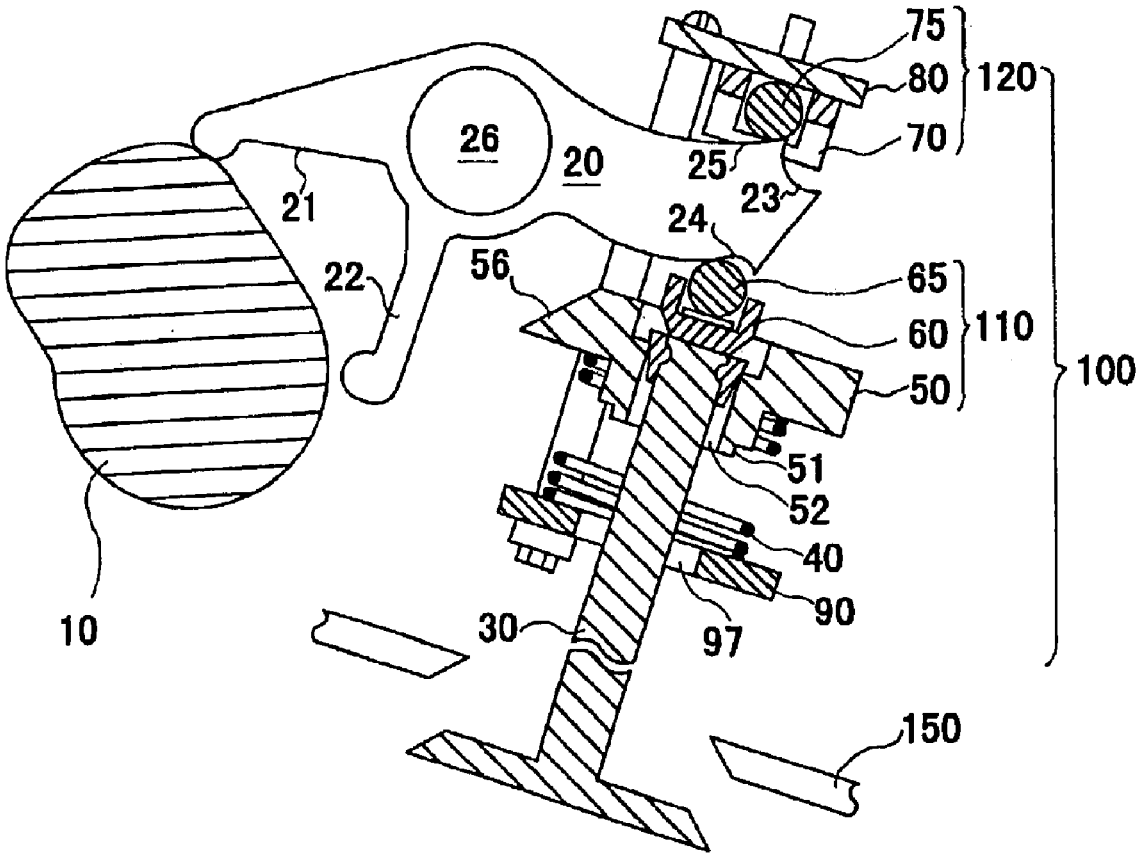
FIG. 4 is a schematic sectional view along line A—A in FIG. 1 illustrating the condition in which the mechanism for controlling the intake valve of an internal combustion engine according to the present invention has just opened the intake valve a little.
Figure 5:
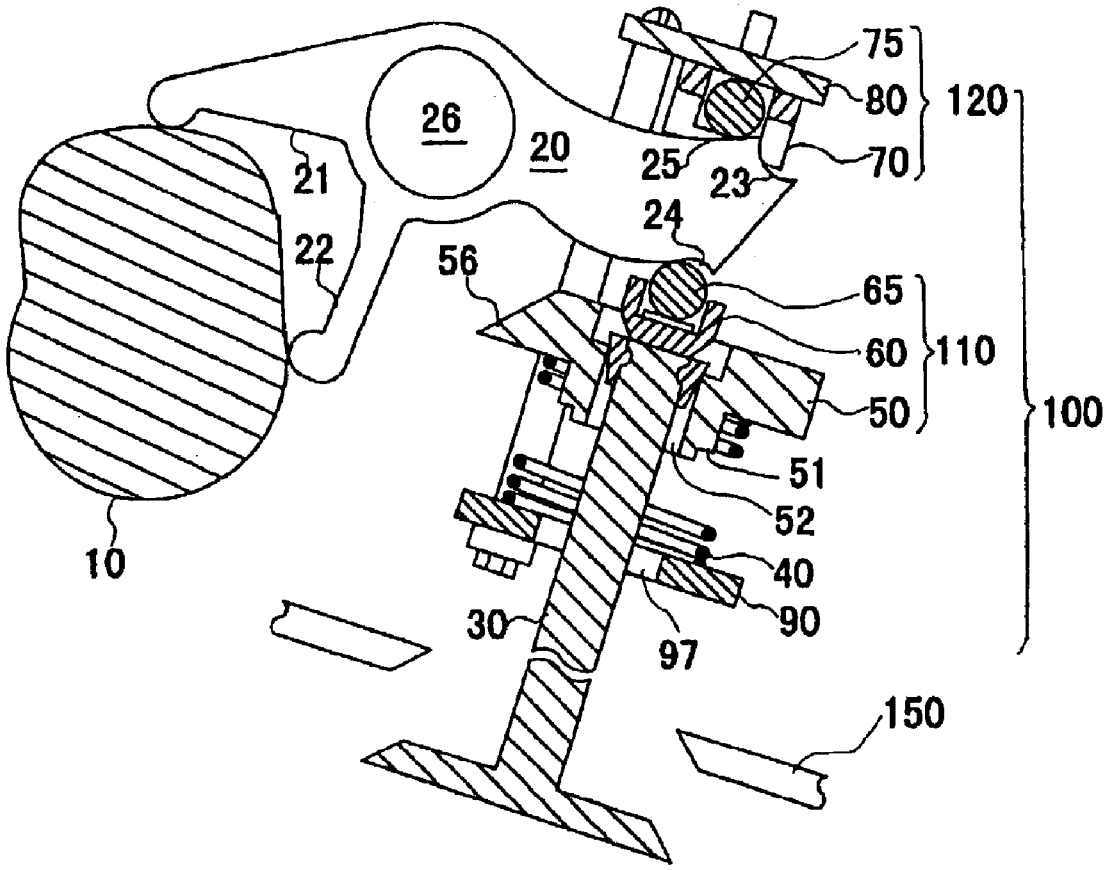
FIG. 5 is a schematic sectional view along line A—A in FIG. 1 illustrating the condition in which the mechanism for controlling the intake valve of an internal combustion engine according to the present invention has completely opened the intake valve.
Figure 6:
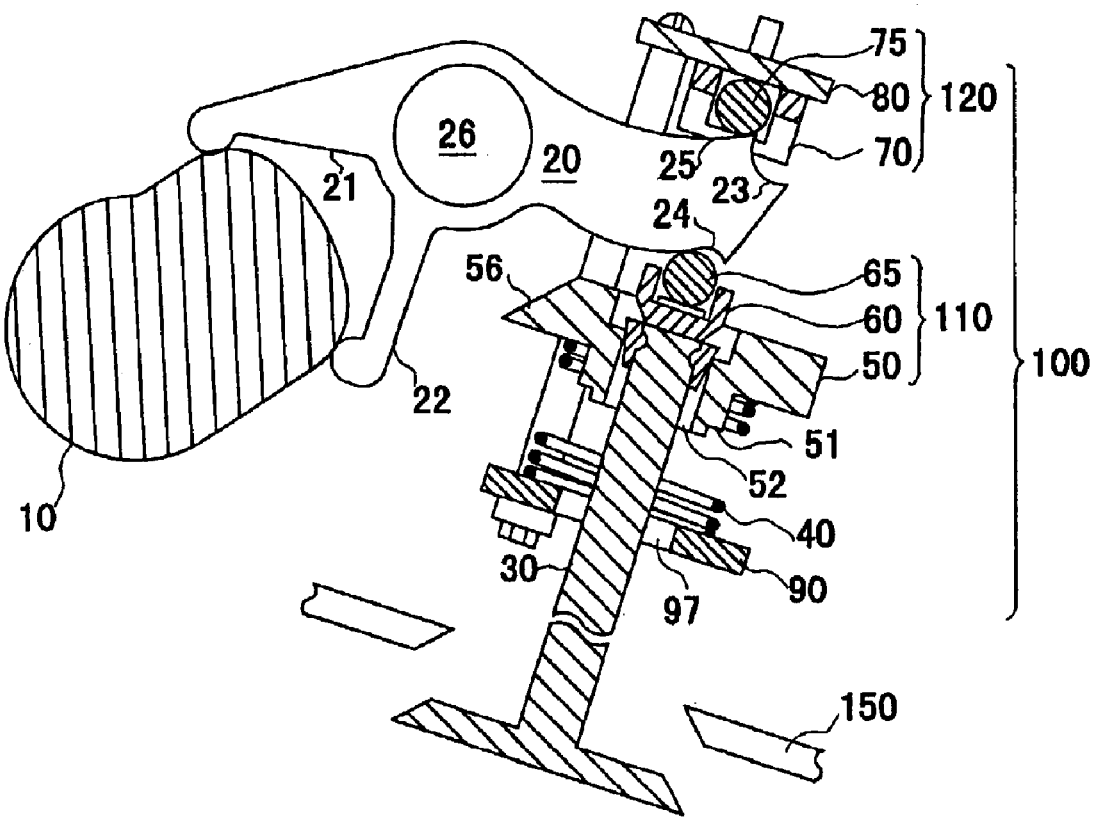
FIG. 6 is a schematic sectional view along line A—A in FIG. 1 illustrating the condition in which the mechanism for controlling the intake valve of an internal combustion engine according to the present invention is going to close the intake valve.
Figure 7:
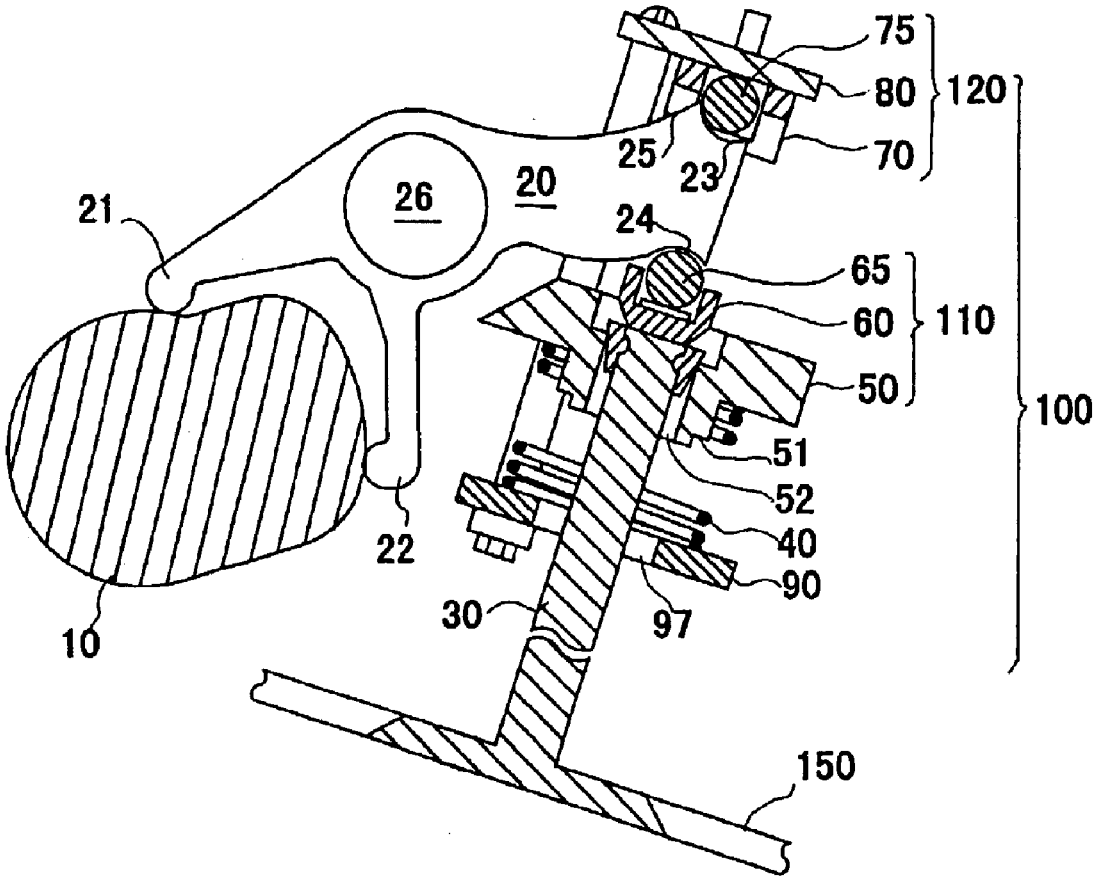
FIG. 7 is a schematic sectional view along line A—A in FIG. 1 illustrating the condition in which the mechanism for controlling the intake valve of an internal combustion engine according to the present invention has completely closed the intake valve.

Next, it is to describe the operation course of the intake valve control mechanism according to the present invention. At the initial position shown in FIG. 3, the first cooperating part 23 of the rocker engages the upper roller 75, the second cooperating part 24 engages the lower roller 65. As the cam 10 rotates in clockwise direction towards the position shown in FIG. 4, the arm 21 of the rocker 20 is pushed upwardly, thus, the other end of the rocker descend and at the same time moves towards the left, the second cooperating part 24 of the rocker 20 presses the lower roller 65 downwardly and thus the stopper 30 is pressed downwardly so that the intake valve is opened. Simultaneously, due to the rightward movement of the rocker 20, the first cooperating part 23 of the rocker moves rightwards to cross over the upper roller 75 as shown in FIG. 4 so that the third cooperating part 25 engages the upper roller 75. As the cam rotates to the position shown in FIG. 5, the intake valve opens to the largest. According to the above description, the bottom plate 90 is free relative to the cylinder wall 150, therefore, there is no spring resistance when the stopper is opened, so the energy consumed by the engine per se may be reduced, namely, oil may be saved. Subsequently, as the cam further rotates to the position shown in FIG. 6, the cam presses the arm 22 of the rocker downwardly, thus, the other end of the rocker rises and at the same time moves leftwards so that the third cooperating part 25 of the rocker applies an upward lift force which is transmitted via the top plate 80, the blots 98, the bottom plate 90, the spiral spring 40 and the intermediate support 50 to lift the stopper 30 so that the stopper moves in the direction of closing. After the intake valve is closed by the stopper, the cam continues to rotate, so the third cooperating part 25 of the rocker 20 compresses the spring 40 so as to apply greater force on the stopper 30 and thus closes the intake valve reliably. At the same time, because the rocker 20 moves leftwards as shown in FIG. 7, the upper roller 75 slides onto the first cooperating part 23 of the rocker so as to ensure the stopper is at the closed position. As the cam continues its rotation, the above described course repeats.

The mechanism for controlling the intake valve of an internal combustion engine according to the present invention has following advantages in addition to the advantage of saving oil: because no large force is applied, the cam and the rocker may be made quite small so as to reduce the dimension and weight. Moreover, because the resistance is small, the intake valve may be opened larger than the traditional design, this facilitates introducing more air under the high speed operation.

In addition, because of the unique design of the cam and the rocker of the present invention, the intake valve may be rapidly opened within 0°–40° of the rotation angle of the crank shaft, kept completely open within 40°–140° of the rotation angle of the crank shaft, and rapidly closed completely within 140°–180° of the rotation angle of the crank shaft. Thus, the opening time of the intake valve is extended, this results in more and faster intake so that the power output of the engine run at high speed is increased, the torque is enlarged, and the efficiency is improved.

Figure 8:
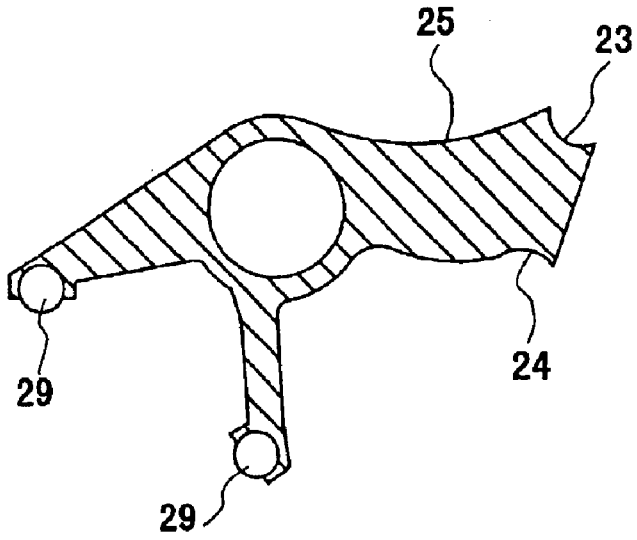
FIG. 8 shows another embodiment of the double-arm rocker.
Figure 9:
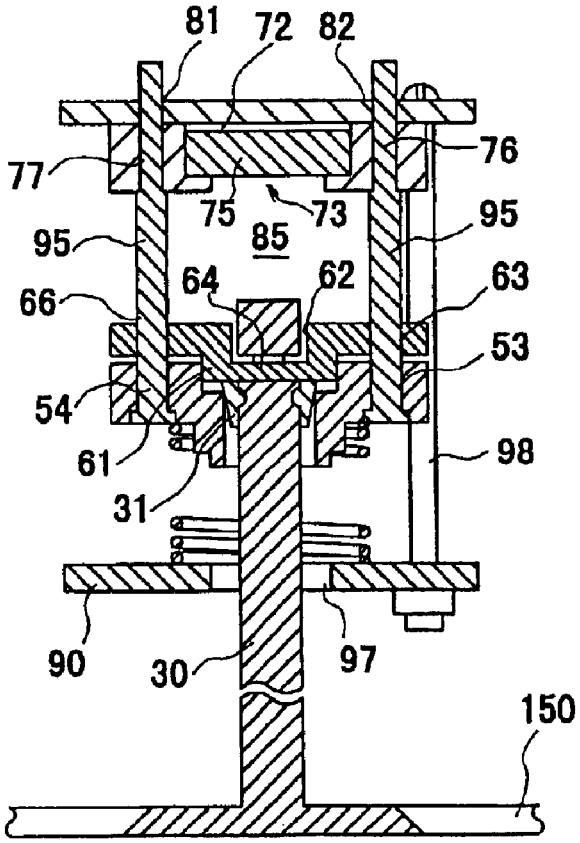
FIG. 9 is a schematic sectional view along line B—B in FIG. 1 illustrating the mechanism for controlling the intake valve of an internal combustion engine according to the present invention, wherein the rocker and the cam are omitted.
Figure 10:
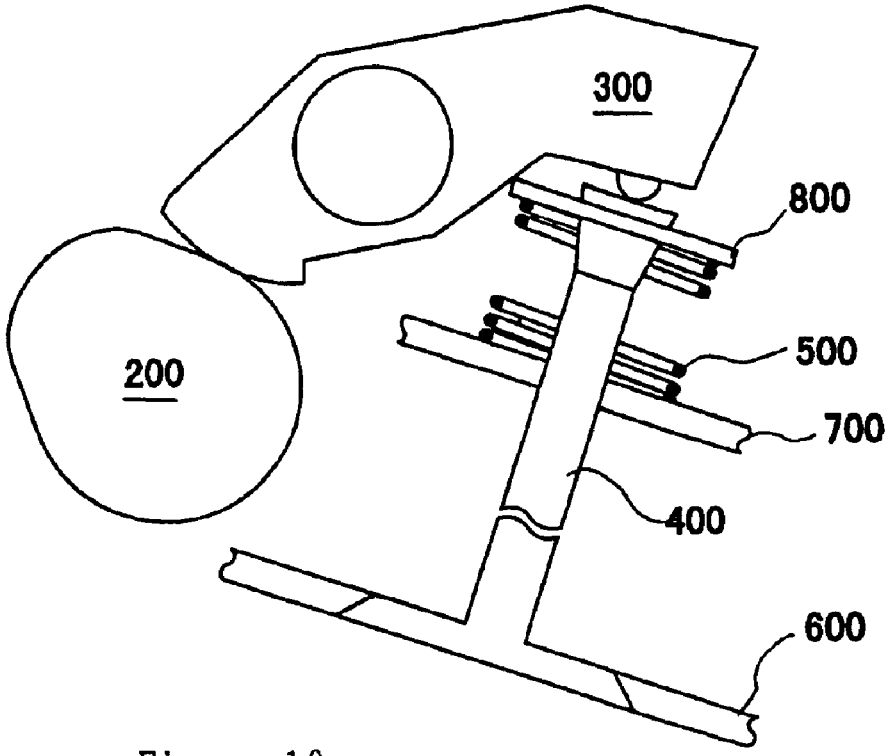
FIG. 10 illustrates a traditional mechanism for controlling the intake valve of an internal combustion engine in the closed condition.
Figure 11:
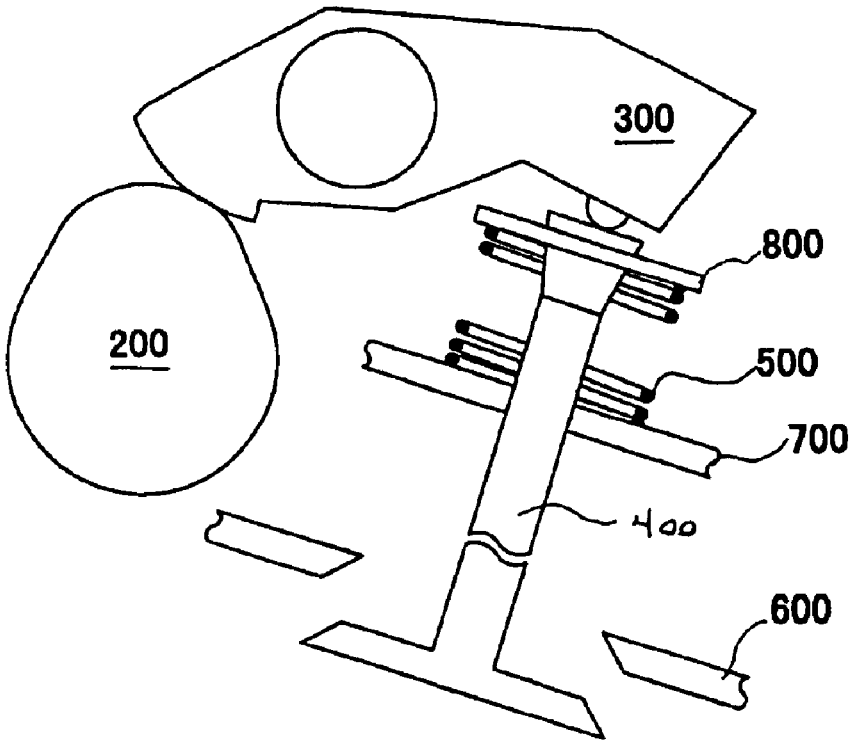
FIG. 11 illustrates a traditional mechanism for controlling the intake valve of an internal combustion engine in the opened condition.

As shown in FIG. 8, rollers 29, 29 may also be provided in the end of two arms of the rocker so that the engagement between the cam and the rocker is more smooth.

The above is only one preferred embodiment of the present invention described with reference to the accompanied drawings, persons skilled in the art may made many variations and modifications within the scope of the attached claims according to the concepts and thoughts of the present invention.

What is claimed is:

1. An apparatus for controlling an intake valve of an internal combustion engine, said apparatus comprising:

a rotatable cam having a substantially elliptical configuration;

a double-armed rocker, a first arm being operable with said rotatable cam and a second arm having plural cooperating parts; and a joining mechanism, having a plurality of rollers, each of said rollers being operable with said cooperating parts, at least one of said rollers being urged against one of said cooperating parts by a spring attached to a bottom plate, the bottom plate being free with respect to a cylinder wall of the combustion engine when the apparatus is mounted in the engine, said at least one of the rollers being connected to a stopper of the intake valve.

2. The apparatus of claim 1, said first arm comprising two arms configured in a "V" shape.

3. The apparatus of claim 2, wherein said first arm includes rollers between said rotatable cam and said two arms.

4. The apparatus of claim 1, wherein said second arm has a varying width, whereby said stopper opens from and closes against a cylinder wall as said rollers of said joining mechanism operate with said cooperating parts.

5. The apparatus of claim 4, wherein said second arm has a small width between some of said plural cooperating parts, thereby closing said stopper against said cylinder wall, and a larger width between other of said plural cooperating parts, thereby pushing said stopper away from said cylinder wall.

6. The apparatus of claim 1, wherein said bottom plate is free with respect to said cylinder wall.

7. A mechanism for controlling the intake valve of an internal combustion engine comprising:

a cam;

a rocker;

a stopper; and a joining mechanism joining the rocker and the stopper, wherein the cam is formed on a crank shaft, the cam having a substantially elliptical configuration, the rocker is able to rock about an axis through its center, one side of the rocker having two arms forming a "V" shape, said two arms engaging the cam, the other side of the rocker having only one arm, a first cooperating part, a second cooperating part, and a third cooperating part being formed in the end of said only one arm, from bottom to top, the joining mechanism including a bottom plate, a spiral spring having a spring constant, a lower cooperating unit, a first connection element, an upper cooperating unit and a second connection element, the bottom plate being free with respect to a cylinder wall, the spiral spring being pressed between the lower cooperating unit and the bottom plate and the spring constant of the spiral spring being comparatively small, the upper end of the stopper passing through an opening centered in the bottom plate and the inner hole of the spiral spring and being mounted on the lower cooperating unit, the lower cooperating unit and the upper cooperating unit being assembled together by means of the first connection element, the upper cooperating unit being capable of sliding with respect to the first connection element, the upper cooperating unit and the bottom plate being mounted together by means of the second connection element, whereby at the initial position of each cycle, the cam engages one arm of the two arms in the rocker, the first cooperating unit of the rocker engages the upper cooperating part, and the second cooperating part of the rocker engages the lower cooperating part; accompanying the rotation of the cam, the rocker rocks, the second cooperating part downwardly presses the lower cooperating unit so that the whole of the joining mechanism moves downwardly to push the stopper for opening the intake valve, the third cooperating part shifts to engage the upper cooperating part; accompanying the continued rotation of the cam, the other arm of the two arms engages the cam, the rocker racks in a reverse direction, the third cooperating part upwardly pushes the upper cooperating unit so that the intake valve is closed, and the first cooperating part returns to engage the upper cooperating unit.

8. The mechanism according to claim 7 wherein the lower cooperating unit includes an intermediate support, a lower roller seat, a lower roller, said intermediate support including a hole for mounting the end of the stopper around its central axis, the lower roller seat being formed on an upper surface of the intermediate support, a lower roller being provided in the lower roller seat, the second cooperating part engaging the lower roller, and wherein the upper cooperating unit includes an upper roller seat, an upper roller and a top plate, an upper roller being provided in the upper roller seat, the upper roller being exposed out of the bottom of the upper roller seat for cooperating with the first cooperating part or third cooperating part, the top plate being covered on the upper roller seat, the first connection elements being two pins whose longitudinal section is trapezoidally shaped, the first connection elements passing through holes provided in the intermediate support, the lower roller seat, the upper roller seat and the top plate so as to connect them together, the second connection element being two bolts which pass through the bolt holes provided in the top plate and the bottom plate so as to connect them together.

9. The mechanism according to claim 7 wherein rollers are provided in the end of the two arms of the rocker.

* * * * *